US005928856A

United States Patent [19]

Weaver et al.

[11] Patent Number: 5,928,856

[45] Date of Patent: Jul. 27, 1999

[54] THERMOGRAPHIC IMAGING ELEMENT

[75] Inventors: Thomas D. Weaver, Rochester; David F. Jennings, Penfield, both of N.Y.

[73] Assignee: Eastman Kodak Company, Rochester, N.Y.

[21] Appl. No.: 09/045,384

[22] Filed: Mar. 20, 1998

[51] Int. Cl.[6] ..... G03C 1/498

[52] U.S. Cl. ..... 430/617; 430/619

[58] Field of Search ..... 430/617, 619

[56] References Cited

U.S. PATENT DOCUMENTS

| | | |
|---|---|---|
| 3,753,395 | 8/1973 | Poot et al. . |
| 3,767,414 | 10/1973 | Huffman et al. . |
| 3,996,397 | 12/1976 | Laridon et al. . |
| 4,013,473 | 3/1977 | Willems et al. . |
| 4,076,534 | 2/1978 | Noguchi et al. . |
| 4,082,901 | 4/1978 | Laridon et al. . |

FOREIGN PATENT DOCUMENTS

| | | |
|---|---|---|
| 654355 | 11/1993 | European Pat. Off. . |
| 582144 | 2/1994 | European Pat. Off. . |
| 677775 | 3/1994 | European Pat. Off. . |
| 677776 | 3/1994 | European Pat. Off. . |
| 678775 | 3/1994 | European Pat. Off. . |
| 678760 | 5/1994 | European Pat. Off. . |
| 683428 | 4/1995 | European Pat. Off. . |
| 687572 | 5/1995 | European Pat. Off. . |
| 671283 | 9/1995 | European Pat. Off. . |
| 671284 | 9/1995 | European Pat. Off. . |
| 674217 | 9/1995 | European Pat. Off. . |
| 713133 | 5/1996 | European Pat. Off. . |
| 1451403 | 10/1976 | United Kingdom . |
| 2083726 | 3/1982 | United Kingdom . |
| 94/14618 | 7/1994 | WIPO . |

OTHER PUBLICATIONS

U.S. application No. 08/770,750, Weaver et al., filed Dec. 19, 1996.

Anonymous: "Photothermographic Element, Composition and Process," Research Disclosure, vol. 105, No. 13, Jan. 1973, pp. 16–21.

*Primary Examiner*—Thorl Chea
*Attorney, Agent, or Firm*—Edith A. Rice

[57] ABSTRACT

A thermographic imaging element comprises:

(a) a support;

(b) an imaging layer comprising:

(i) an oxidizing agent;

(ii) a first reducing agent which has high activity with an activation energy of less than 10 Joules/sq.cm.;

(iii) a second reducing agent which has low activity with an activation energy of greater than or equal to 10 Joules/sq. cm.; and (iv) a third reducing agent comprising a boron compound containing at least one boron-hydrogen bond.

21 Claims, 1 Drawing Sheet

THERMOGRAPHIC IMAGING ELEMENT

FIELD OF THE INVENTION

The present invention relates to a thermographic imaging element for use in direct thermal imaging.

BACKGROUND OF THE INVENTION

Thermal imaging is a process in which images are recorded by the use of imagewise modulated thermal energy. In general there are two types of thermal recording processes, one in which the image is generated by thermally activated transfer of a light absorbing material, the other generates the light absorbing species by thermally activated chemical or physical modification of components of the imaging medium. A review of thermal imaging methods is found in "Imaging Systems" by K. I. Jacobson R. E. Jacobson—Focal Press 1976.

Thermal energy can be delivered in a number of ways, for example by direct thermal contact or by absorption of electromagnetic radiation. Examples of radiant energy include infra-red lasers. Modulation of thermal energy can be by intensity or duration or both. For example a thermal print head comprising microscopic resistor elements is fed pulses of electrical energy which are converted into heat by the Joule effect. In a particularly useful embodiment the pulses are of fixed voltage and duration and the thermal energy delivered is then controlled by the number of such pulses sent. Radiant energy can be modulated directly by means of the energy source e.g. the voltage applied to a solid state laser.

Direct imaging by chemical change in the imaging medium usually involves an irreversible chemical reaction which takes place very rapidly at elevated temperatures—say above 100° C.—but at room temperature the rate is orders of magnitude slower such that effectively the material is stable.

A particularly useful direct thermal imaging element uses an organic silver salt in combination with a reducing agent. Such systems are often referred to as 'dry silver'. In this system the chemical change induced by the application of thermal energy is the reduction of the transparent silver salt to a metallic silver image.

PROBLEM TO BE SOLVED BY THE INVENTION

Prior art thermal imaging elements tend to have a relatively low dynamic range or relatively a narrow latitude which limits the number of tones or levels of gray that can be recorded.

SUMMARY OF THE INVENTION

One aspect of this invention comprises a thermographic imaging element comprising:

(a) a support;

(b) an imaging layer comprising:

(i) an oxidizing agent;

(ii) a first reducing agent which has high activity with an activation energy of less than 10 Joules/sq.cm.;

(iii) a second reducing agent which has low activity with an activation energy of greater than or equal to 10 Joules/sq.cm.; and (iv) a third reducing agent comprising a boron compound containing at least one boron-hydrogen bond.

ADVANTAGEOUS EFFECT OF THE INVENTION

This invention provides a heat-sensitive recording material suitable for direct thermal imaging having a high dynamic range (Dmax≧2.5, Dmin≦0.1, as described hereinafter) and a wide latitude (E1–E2, as described hereinafter) such that a large number of tones or levels of gray can be recorded.

DETAILED DESCRIPTION OF THE INVENTION

Figure 1:
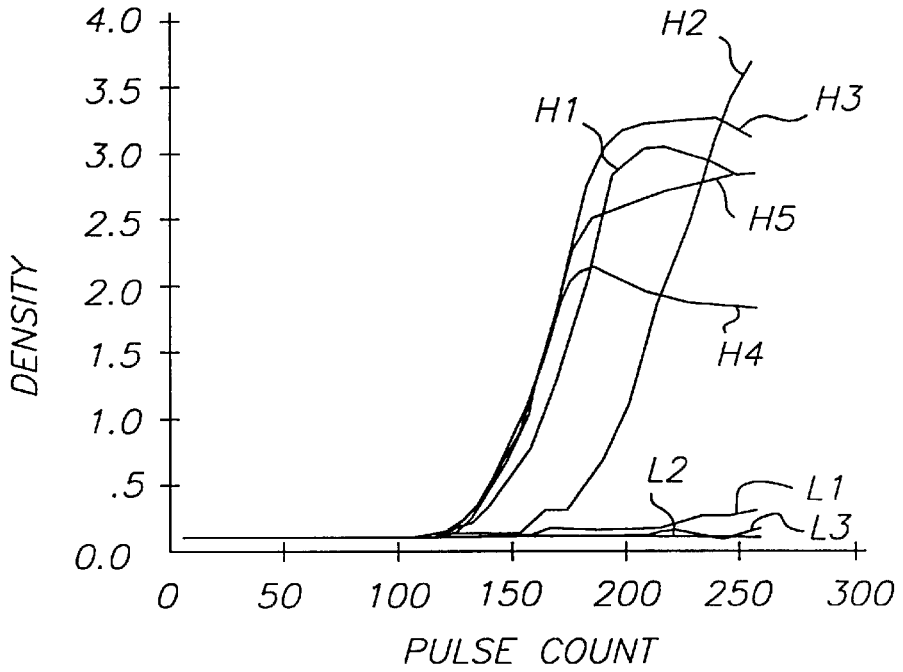
FIG. 1 shows the characteristic sensitometric curves obtained by plotting image density (D) versus the imaging thermal energy expressed as the number of thermal pulses applied. Labels identify the examples as high activity (H1 through H5) and low activity (L1 through L3) as shown in Tables 1 & 2.

The thermographic element and composition according to the invention comprise an oxidation-reduction image-forming composition which contains a silver salt, a high activity reducing agent, as defined herein) and a low activity reducing agent (as defined herein).

The oxidizing agent is preferably a silver salt of an organic acid. Suitable silver salts include, for example, silver behenate, silver stearate, silver oleate, silver laureate, silver hydroxy stearate, silver caprate, silver myristate, silver palmitate silver benzoate, silver benzotriazole, silver terephthalate, silver phthalate saccharin silver, phthalazinone silver, benzotriazole silver, silver salt of 3-(2-carboxyethyl-4-4-hydroxymethyl-4-thiazoline-2-thione, silver salt of 3-mercapto-4-phenyl-1,2,4-triazole and the like. In most instances silver behenate is most useful.

A variety of reducing agents can be employed in the imaging composition of the invention. Typical reducing agents which can be used include, for example:

(1) Sulfonamidophenol reducing agents in thermographic materials are described in U.S. Pat. No. 3,801,321 issued Apr. 2, 1974 to Evans et al., the entire disclosure of which is incorporated herein by reference, and sulfonamidoaniline reducing agents;

(2) Other reducing agents are substituted phenol and substituted naphthol reducing agents. Substituted phenols which can be used include, for example, bisphenols, e.g., bis(2-hydroxy-3-t-butyl-5-methylphenyl) methane, bis(6-hydroxy-m-tolyl)mesitol, 2,2-bis(4-hydroxy-3-methylphenyl)propane, 4,4 -ethylidene-bis(2-t-butyl-6-methylphenol) and 2,2-bis (3,5-dimethyl-4-hydroxyphenyl) propane. Substituted naphthols which can be used include, for example, bis-b-naphthols such as those described in U.S. Pat. No. 3,672,904 of deMauriac, issued Jun. 27, 1972, the entire disclosure of which is incorporated herein by reference. Bis-b-naphthols which can be used include, for example, 2,2'-dihydroxy-1,1'-binaphthyl, 6,-6'-dibromo-2, 2'-dihydroxy-1,1'-binaphthyl, 6,6'-dinitro-2,2'-dihydroxy-1,1'-binaphthyl, and bis-(2-hydroxy-1-naphthol) methane.

(3) Other reducing agents include polyhydroxybenzene reducing agents such as hydroquinone, alkyl-substituted hydroquinones such as tertiary butyl hydroquinone, methyl hydroquinone, 2,5-dimethyl hydroquinone and 2,6-dimethyl hydroquinone, (2,5-dihydroxyphenyl) methylsulfone, catechols and pyrogallols, e.g., pyrocatechol, 4-phenylpyrocatechol, t-butylcatechol, pyrogallol or pyrogallol derivatives such as pyrogallol ethers or esters; 3,4-dihydroxybenzoic acid, 3,4-dihydroxybenzoic acid, 3,4-dihydroxybenzoic acid esters such as dihydroxybenzoic acid, methyl ester, ethyl ester, propyl ester or butyl ester; gallic acid, gallic acid esters such as methyl gallate, ethyl gallate, propyl gallate and the like, gallic acid amides;

(4) aminophenol reducing agents, such as 2,4-diaminophenols and methylaminophenols can be used;

(5) ascorbic acid reducing agents such as ascorbic acid and ascorbic acid derivatives such as ascorbic acid ketals can be used;

(6) hydroxylamine reducing agents can be used;

(7) 3-pyrazolidone reducing agents such as 1-phenyl-3-pyrazolidone can be used;

(8) other reducing agents which can be used include, for example, hydroxycoumarones, hydroxycoumarans, hydrazones, hydroxaminic acids, indane-1,3-diones, aminonaphthols, pyrazolidine-5-ones, hydroxylamines, reductones, esters of amino reductones, hydrazines, phenylenediamines, hydroxyindanes, 1,4-dihydroxypyridines, hydroxy-substituted aliphatic carboxylic acid arylhydrazides, N-hydroxyureas, phosphonamidephenols, phosphonamidanilines, α-cyanophenylacetic esters sulfonamidoanilines, aminohydroxycycloalkenone compounds, N-hydroxyurea derivatives, hydrazones of aldehydes and ketones, sulfhydroxamic acids, 2-tetrazolythiohydroquinones, e.g., 2-methyl-5-(1-phenyl-5-tetrazolythio) hydroquinone, tetrahydroquinoxalines, e.g. 1,2,3,4-tetrahydroquinoxaline, amidoximes, azines, hydroxamic acids, 2-phenylindan- 1,3-dione, 1,4-dihydropyridines, such as 2,6-dimethoxy-3,5-dicarbethoxy-1,4-dihydropyridine.

To determine the activity of a reducing agent the following procedure is conducted. A test formulation containing the following activity formulation #1 is prepared.

Activity Formulation #1

| | |
|---|---|
| SILVER BEHENATE | 9.7 millimole/$m^2$ |
| POLY(VINYL BUTYRAL) | 4320 milligram/$m^2$ |
| SUCCINIMIDE | 8.6 millimole/$m^2$ |
| TEST REDUCING AGENT | 8.3 millimole/$m^2$ |

The formulation is coated on a support and is thermally imaged using a thin film thermal head in contact with a combination of the imaging medium and a protective film of 6 micron thickness polyester sheet. Contact of the head to the element is maintained by an applied pressure of 313 g/cm heater line. The line write time is 15 millisec. broken up into 255 increments corresponding to the pulse width referred to above. Energy per pulse is 0.041 Joule/sq.cm. Individual picture elements are of a size corresponding to 300 dots per inch.

The thermal sensitive coatings are treated with a linearly increasing pattern of pulses from 5 to 255 in 10 pulse increments. Densities of the resulting image steps are measured with an X-Rite 361 densitometer, commercially availabel fron X-Rite Corporation, in the 'ortho' mode. In the activity determination for low activity reducing agents, an additional test in which the average printing energy per pulse is increased to 0.085 Joules per sq. cm is required to generate sufficient density in the case of the low activity reducing agents. Measured activity values for high activity reducing agents, are the same in both tests. Plots of density versus pulse count can then be generated and the activity, E1, the 'toe' of the curve, i.e., the onset of image density, can be read from the plot. The practical measure of E1 is the thermal energy which generates a density 0.1 greater than Dmin. Energies can be converted from pulse count to Joules/sq.cm. using the factors given above.

Illustrative high activity reducing agents are given in Table 1.

TABLE 1

High Activity Reducing Agents

| ID | REDUCING AGENT | ACTIVATION ENERGY, E1(Joules/$cm^2$) |
|---|---|---|
| H1 | 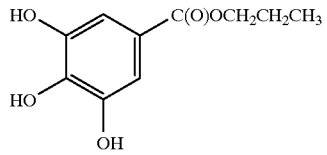 | 5.6 |
| H2 | 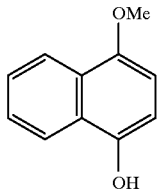 | 6.7 |
| H3 | 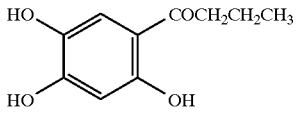 | 5.5 |
| H4 | 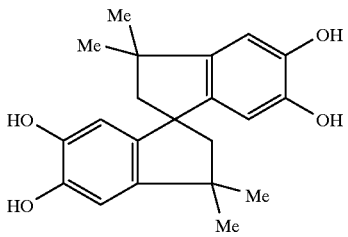 | 5.7 |
| H5 | 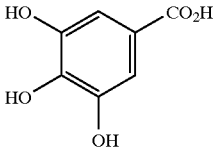 | 5.7 |

In preferred embodiments of the invention, the high activity reducing agent has an activation energy between about 1 and 10 Joules/sq. cm.

Illustrative low activity reducing agents are given in Table 2.

TABLE 2

Low Activity Reducing Agents

| ID | Reducing Agent | Activation Energy, E1 (Joules/cm$^2$) |
|---|---|---|
| L1 | 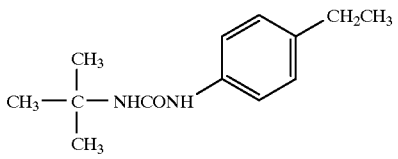 | 10.2 |
| L2 | 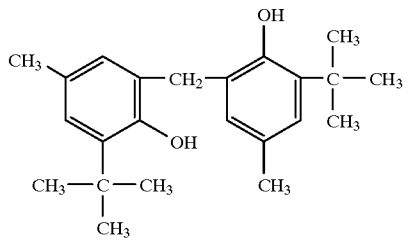 | 13.9 |
| L3 | 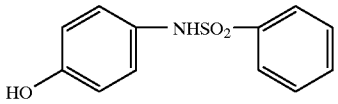 | 11.5 |

Low activity reducing agents have an activity, as defined herein, of equal to or greater than 10 Joules/sq. cm. The low activity reducing agents preferably have an activity between about 10 and about 20 Joules/sq. cm., more preferably between about 10 and about 15 Joules/sq.cm.

Plots of the density versus pulse count for all the reducing agents of Tables 1 & 2 are given in FIG. 1. FIG. 1 shows the characteristic sensitometric curves obtained by plotting image density (D) versus the imaging thermal energy expressed as the number of thermal pulses applied. Labels identify the examples as high activity (H1 through H5) and low activity (L1 through L3) as shown in Tables 1 & 2.

Figure 2:
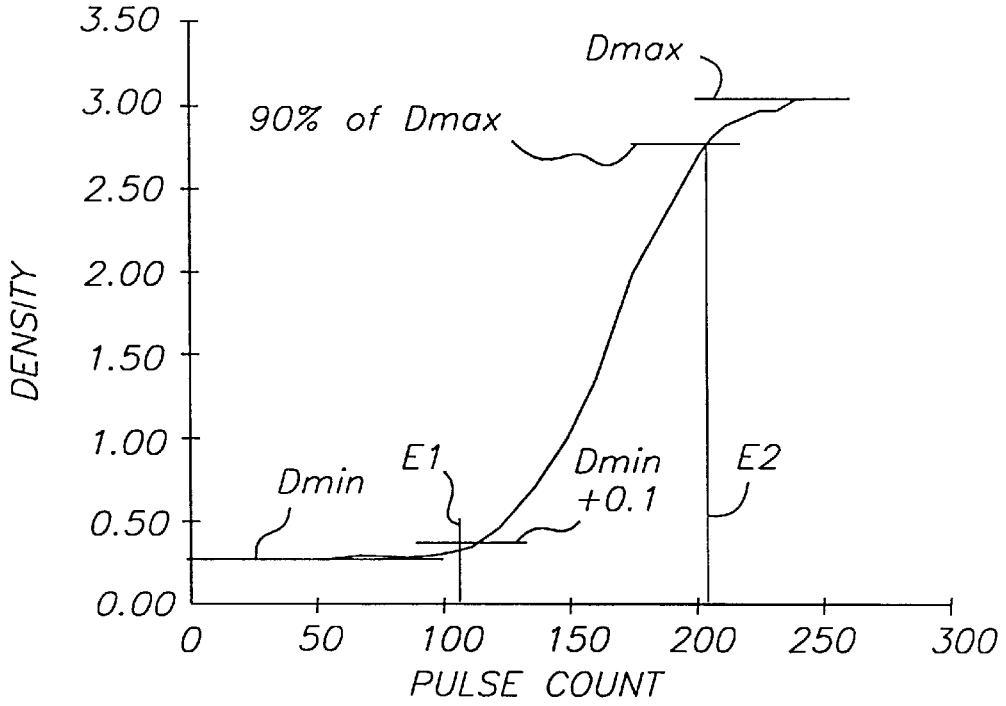
FIG. 2 shows a sensitometric curve showing E1, E2, $D_{min}$ and $D_{max}$.

From the same plots of density versus pulse count, the $D_{max}$, $D_{min}$, E1, and E2 values, as described below and in FIG. 2, can also be obtained. The plots of density versus pulse count also provides contrast and tonal range. Contrast is an expression of the rate of change of image density versus imaging energy. Depending on the end use of the image different parts of the image range have greater or lesser importance. For the material herein described the whole of the density range is important so the applicable measure of contrast is over the range of densities from the 'toe' (E1) or onset of image density, to the shoulder (E2) or onset of $D_{max}$. The practical measure of E1 is the thermal energy which generates a density 0.1 greater than Dmin. Similarly the practical measure of E2 is the thermal energy that generates a density 90% of $D_{max}$. The tonal range is the value of E2–E1.

Under the action of the applied thermal energy the density of the image increases from a minimum ($D_{min}$) value to a maximum ($D_{max}$) value. It is desirable for the $D_{min}$ to be as low as possible and the $D_{max}$ to be high enough that pleasing image density is achieved. For a transmission image $D_{min}$ of less than 0.1 and $D_{max}$ of greater than 2.5 are considered acceptable. The dynamic range of the thermal imaging material is $D_{max}$–$D_{min}$.

The amount of high activity reducing agent used in the thermal imaging material of this invention is preferably about 0.005 to about 0.2 millimoles/mole Ag, more preferably about 0.01 to about 0.1. The amount of low activity reducing agent is preferably about 0.05 to about 2, more preferably about 0.1 to about 1 moles/mole Ag. Typically the ratio of the amount of high activity reducing agent to the amount of low activity reducing agent is about 1 to 3 to about 1 to 30, particularly preferred is a ratio of about 1 to about 10.

Illustrative boron hydride compounds include compounds of Structures 1 and 2:

STRUCTURE 1

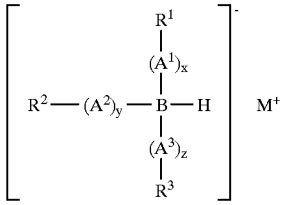

STRUCTURE 2

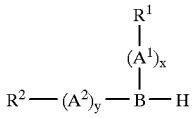

wherein $R^1$, $R^2$, $R^3$ can be the same or different, and are selected from hydrogen, substituted or unsubstituted alkyl, substituted or unsubstituted cycloalkyl, or substituted or unsubstituted aryl; or $R^1$ and $R^2$, or $R^2$, and $R^3$, or $R^1$, and $R^3$, or $R^1$ and $R^2$ and $R^3$ can form one or more ring structures; $A^1$, $A^2$ and $A^3$ each represents a non-carbon atom; x, y, and z, are independently 0 or 1 and $M^+$ is a cation.

Preferably, $A^1$, $A^2$ and $A^3$ are non-carbon atoms independently selected from N, O, P, and S. M is typically Li, Na, K, or $(R^4)_4N$, where $R^4$ is hydrogen, substituted or unsubstituted alkyl, substituted or unsubstituted cycloalkyl, or substituted or unsubstituted aryl.

Preferred compounds of Structure 1 are those wherein each of $R^1$, $R^2$, and $R^3$ is independently hydrogen or substituted or unsubstituted alkyl, with the proviso that if hydrogen, then the corresponding x, y or z is 0; and if substituted or unsubstituted alkyl, then the corresponding x, y or z is 1.

Compounds of Structure 2 can be complexed with a Lewis base. Typical Lewis bases include $R_3N$, $R_3P$, $R_2O$, and $R_2S$, where each R is selected from: hydrogen, substituted or unsubstituted alkyl, substituted or unsubstituted cycloalkyl, and substituted or unsubstituted aryl.

Preferred compounds of Structure 2 are those wherein x and y are each 1 and each of $R^1$ and $R^2$ is hydrogen and compounds wherein x and y are each 1, $A^1$ and $A^2$ are each oxygen or nitrogen and $R^1$, $R^2$, and $R^3$ are each substituted or unsubstituted alkyl.

When reference in this application is made to a particular moiety as a "group", this means that the moiety may itself be unsubstituted or substituted with one or more substituents (up to the maximum possible number). For example, "alkyl group" refers to a substituted or unsubstituted alkyl, while "benzene group" refers to a substituted or unsubstituted benzene (with up to six substituents). Generally, unless otherwise specifically stated, substituent groups usable on molecules herein include any groups, whether substituted or unsubstituted, which do not destroy properties necessary for the photographic utility. Examples of substituents on any of the mentioned groups can include known substituents, such as: halogen, for example, chloro, fluoro, bromo, iodo; alkoxy, particularly those "lower alkyl" (that is, with 1 to 6 carbon atoms, for example, methoxy, ethoxy; substituted or unsubstituted alkyl, particularly lower alkyl (for example, methyl, trifluoromethyl); thioalkyl (for example, methylthio or ethylthio), particularly either of those with 1 to 6 carbon atoms; substituted and unsubstituted aryl, particularly those having from 6 to 20 carbon atoms (for example, phenyl); and substituted or unsubstituted heteroaryl, particularly those having a 5 or 6-membered ring containing 1 to 3 heteroatoms selected from N, O, or S (for example, pyridyl, thienyl, furyl, pyrrolyl); acid groups, such as carboxy or sulfo groups, sulfoamino groups, amido groups, carboxy ester groups, and the like. With regard to any alkyl group or alkylene group, it will be understood that these can be branched or unbranched and include ring structures.

Particularly preferred boron compounds are shown in Table 3, together with a comparative compound which contains no boron-hydrogen bonds.

TABLE 3

Boron Compounds

| ID | Structure |
|---|---|
| B1 (Inventive) | 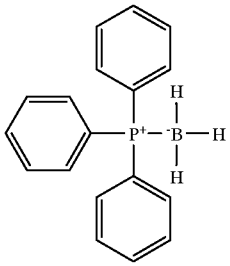 |
| B2 (Inventive) | 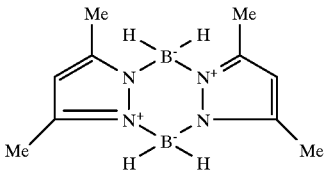 |
| B3 (Inventive) | 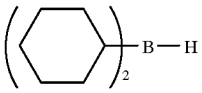 |
| B4 (inventive) | 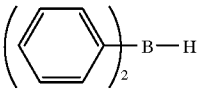 |

TABLE 3-continued

Boron Compounds

| ID | Structure |
|---|---|
| B5 (inventive) | $(CH_3)_3—C(CH_2)_2—BH_2$ |
| B6 (inventive) | 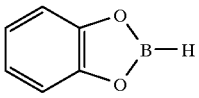 |
| B7 (inventive) | 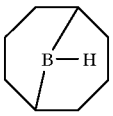 |
| B8 (inventive) | 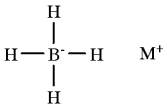 wherein M is Na, K or Li. |
| C1 (Comparative) | 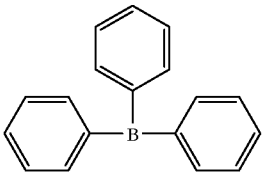 |

The activation energy, E1, for borin compounds B1 and B2 were measured and compared to comparative compound C1. The results are shown in Table 3A.

TABLE 3A

Activation Energy of Boron Compounds

| ID | E1 |
|---|---|
| S1 | 9.7 |
| S2 | 4.3 |
| C1 | * |

*C1 did not reach a density of 0.1 above D min, thus showing the comparative boron compound has no reducing agent effect.

The amount of boron compound used in the thermal imaging material of this invention is preferably about 0.005 to about 2 millimoles/mole Ag, more preferably about 0.005 to about 0.5 and most preferable about 0.005 to about 0.2 moles/mole Ag.

The imaging composition and element of the invention can also contain a so-called activator-toning agent, also known as an accelerator-toning agent or toner. The activator-toning agent can be a cyclic imide and is typically useful in a range of concentration such as a concentration of about 0.10 mole to about 1.1 mole of activator -toning agent per mole of silver salt oxidizing agent in the thermographic material. Typical suitable activator-toning agents are described in Belgian Patent No. 766,590 issued Jun. 15, 1971, the entire disclosure of which is incorporated herein by reference. Typical activator-toning agents include, for example, phthalimide, N-hydroxyphthalimide, N- hydroxy-1,8-naphthalimide, N-potassium phthalimide, N-mercury phthalimide, succinimide and/or N-hydroxysuccinimide. Combinations of activator-toning agents can be employed if desired. Other activator-toning agents which can be employed include phthalazinone, 2-acetyl-phthalazinone and the like.

The thermographic imaging composition of the invention can contain other addenda that aid in formation of a useful image.

A thermographic composition of the invention can contain various other compounds alone or in combination as vehicles, binding agents and the like, which can be in various layers of the thermographic element of the invention. Suitable materials can be hydrophobic or hydrophilic. They are transparent or translucent and include such synthetic polymeric substances as water soluble polyvinyl compounds like poly(vinyl pyrrolidone), acrylamide polymers and the like. Other synthetic polymeric compounds which can be employed include dispersed vinyl compounds such as in latex form and particularly those which increase dimensional stability of photographic materials. Effective polymers include water insoluble polymers of polyesters, polycarbonates, alkyl acrylates and methacrylates, acrylic acid, sulfoalkyl acrylates, methacrylates and those which have crosslinking sites which facilitate hardening or curing as well as those having recurring sulfobetaine units as described in Canadian Patent No. 774,054, the entire disclosure of which is incorporated herein by reference. Especially useful high molecular weight materials and resins include poly(vinyl acetals), such as, poly(vinyl acetal) and poly(vinyl butyral), cellulose acetate butyrate, polymethyl methacrylate, poly(vinyl pyrrolidone), ethylcellulose, polystyrene, polyvinyl chloride, chlorinated rubber, polyisobutylene, butadiene-styrene copolymers, vinyl chloride-vinyl acetate copolymers, copolymers, of vinyl acetate, vinyl chloride and maleic acid and polyvinyl alcohol.

A thermographic element according to the invention comprises a thermal imaging composition, as described above, on a support. A wide variety of supports can be used. Typical supports include cellulose nitrate film, cellulose ester film, poly(vinyl acetal) film, polystyrene film, poly(ethylene terephthalate) film, polycarbonate film and related films or resinous materials, as well as glass, paper, metal and the like supports which can withstand the processing temperatures employed according to the invention. Typically, a flexible support is employed.

The thermographic imaging elements of the invention can be prepared by coating the layers on a support by coating procedures known in the photographic art, including dip coating, air knife coating, curtain coating or extrusion coating using hoppers. If desired, two or more layers are coated simultaneously.

Thermographic imaging elements are described in general in, for example, U.S. Pat. Nos. 3,457,075; 4,459,350; 4,264,725 and 4,741,992 and *Research Disclosure*, June 1978, Item No. 17029.

The components of the thermographic element can be in any location in the element that provides the desired image. If desired, one or more of the components can be in more than one layer of the element. For example, in some cases, it is desirable to include certain percentages of the reducing agent, toner, stabilizer and/or other addenda in an overcoat layer. This, in some cases, can reduce migration of certain addenda in the layers of the element.

The thermographic imaging element of the invention can contain a transparent, image insensitive protective layer. The protective layer can be an overcoat layer, that is a layer that overlies the image sensitive layer(s), or a backing layer, that is a layer that is on the opposite side of the support from the image sensitive layer(s). The imaging element can contain both a protective overcoat layer and a protective backing layer, if desired. An adhesive interlayer can be imposed between the imaging layer and the protective layer and/or between the support and the backing layer. The protective layer is not necessarily the outermost layer of the imaging element.

The protective overcoat layer preferably acts as a barrier layer that not only protects the imaging layer from physical damage, but also prevents loss of components from the imaging layer. The overcoat layer preferably comprises a film forming binder, preferable a hydrophilic film forming binder. Such binders include, for example, crosslinked polyvinyl alcohol, gelatin, poly(silicic acid), and the like. Particularly preferred are binders comprising poly(silicic acid) alone or in combination with a water-soluble hydroxyl-containing monomer or polymer as described in the above-mentioned U.S. Pat. No. 4,828,971, the entire disclosures of which are incorporated herein by reference.

The thermographic imaging element of this invention can include a backing layer. The backing layer is an outermost layer located on the side of the support opposite to the imaging layer. It is typically comprised of a binder and a matting agent which is dispersed in the binder in an amount sufficient to provide the desired surface roughness and the desired antistatic properties.

The backing layer should not adversely affect sensitometric characteristics of the thermographic element such as minimum density, maximum density and photographic speed.

The thermographic element of this invention preferably contains a slipping layer to prevent the imaging element from sticking as it passes under the thermal print head. The slipping layer comprises a lubricant dispersed or dissolved in a polymeric binder. Lubricants the can be used include, for example:

(1) a poly(vinyl stearate), poly(caprolactone)or a straight chain alkyl or polyethylene oxide perfluoroalkylated ester or perfluoroalkylated ether as described in U.S. Pat. No. 4,717,711, the disclosure of which is incorporated by reference.

(2) a polyethylene glycol having a number average molecular weight of about 6000 or above or fatty acid esters of polyvinyl alcohol, as described in U.S. Pat. No. 4,717,712 the entire disclosure of which is incorporated herein by reference;

(3) a partially esterified phosphate ester and a silicone polymer comprising units of a linear or branched alkyl or aryl siloxane as described in U.S. Pat. No. 4,737,485 the entire disclosure of which is incorporated herein by reference;

(4) a linear or branched aminoalkyl-terminated poly (dialkyl, diaryl or alkylaryl siloxane) such as an aminopropyldimethylsiloxane or a T-structure polydimethylsiloxane with an aminoalkyl functionality at the branch-point, as described in U.S. Pat. No. 4,738,950, the entire disclosure of which is incorporated herein by reference;

(5) solid lubricant particles, such as poly (tetrafluoroethylene), poly(hexafluoropropylene) or poly (methylsilylsesquioxane, as described in U.S. Pat. No. 4,829,050, the entire disclosure of which is incorporated herein by reference;

(6) micronized polyethylene particles or micronized polytetrafluoroethylene powder as described in U.S. Pat. No. 4,829,860, the entire disclosure of which is incorporated herein by reference;

(7) a homogeneous layer of a particulate ester wax comprising an ester of a fatty acid having at least 10 carbon atoms and a monohydric alcohol having at least 6 carbon atoms, the ester wax having a particle size of from about 0.5 mm to about 20 mm, as described in U.S. Pat. No. 4,916,112, the entire disclosure of which is incorporated herein by reference;

(8) a phosphonic acid or salt as described in U.S. Pat. No. 5,162,292, the entire disclosure of which is incorporated herein by reference;

(9) a polyimide-siloxane copolymer, the polysiloxane component comprising more than 3 weight % of the copolymer and the polysiloxane component having a molecular weight of greater than 3900, the entire disclosure of which is incorporated herein by reference;

(10) a poly(aryl ester, aryl amide)-siloxane copolymer, the polysiloxane component comprising more than 3 weight % of the copolymer and the polysiloxane component having a molecular weight of at least about 1500, the entire disclosure of which is incorporated herein by reference.

In the thermographic imaging elements of this invention can contain either organic or inorganic matting agents. Examples of organic matting agents are particles, often in the form of beads, of polymers such as polymeric esters of acrylic and methacrylic acid, e.g., poly (methylmethacrylate), styrene polymers and copolymers, and the like. Examples of inorganic matting agents are particles of glass, silicon dioxide, titanium dioxide, magnesium oxide, aluminum oxide, barium sulfate, calcium carbonate, and the like. Matting agents and the way they are used are further described in U.S. Pat. Nos. 3,411,907 and 3,754,924.

The concentration of matting agent required to give the desired roughness depends on the mean diameter of the particles and the amount of binder. Preferred particles are those with a mean diameter of from about 1 to about 15 micrometers, preferably from 2 to 8 micrometers. The matte particles can be usefully employed at a concentration of about 1 to about 100 milligrams per square meter.

The imaging element can also contain an electroconductive layer which, in accordance with U.S. Pat. No. 5,310,640, is an inner layer that can be located on either side of said support. The electroconductive layer preferably has an internal resistivity of less than $5\times10^{11}$ ohms/square.

The protective overcoat layer and the slipping layer may either or both be electrically conductive having a surface resistivity of less than $5\times10^{11}$ ohms/square. Such electrically conductive overcoat layers are described in U.S. Pat. No. 5,547,821, incorporated herein by reference. As taught in the '821 patent, electrically conductive overcoat layers comprise metal-containing particles dispersed in a polymeric binder in an amount sufficient to provide the desired surface resistivity. Examples of suitable electrically-conductive metal-containing particles for the purposes of this invention include:

(1) donor-doped metal oxide, metal oxides containing oxygen deficiencies, and conductive nitrides, carbides, and borides. Specific examples of particularly useful particles include conductive $TiO_2$, $SnO_2$, $V_2O_5$, $Al_2O_3$, $ZrO_2$, $In_2O_3$, ZnO, $TiB_2$, $ZrB_2$, $NbB_2$, $TaB_2$, $CrB_2$, MoB, WB, $LaB_6$, ZrN, TiN, TiC, WC, HfC, HfN, ZrC. Examples of the many patents describing these electrically-conductive particles include U.S. Pat. Nos. 4,275,103, 4,394,441, 4,416,963, 4,418,141, 4,431,764, 4,495,276, 4,571,361, 4,999,276, and 5,122,445;

(2) semiconductive metal salts such as cuprous iodide as described in U.S. Pat. Nos. 3,245,833, 3,428,451 and 5,075,171;

(3) a colloidal gel of vanadium pentoxide as described in U.S. Pat. Nos. 4,203,769, 5,006,451, 5,221,598, and 5,284,714; and (4) fibrous conductive powders comprising, for example, antimony-doped tin oxide coated onto non-conductive potassium titanate whiskers as described in U.S. Pat. Nos. 4,845,369 and 5,116,666.

The following example illustrates the thermographic elements of this invention.

EXAMPLE

High activity developers H1 and H2 were tested as the sole developer, in combination with a low activity developer, and in combination with both a low activity developer and a boron compound having a hydrogen-boron bond. Each formulation was then coated and tested as described.

As further illustration, high activity developers H3, H4 and H5 were tested as the sole developer, and in combination with both a low activity developer and a boron compound. Each formulation was then coated and tested as described. The results are shown in Table 4.

FORMULATION #1 SINGLE DEVELOPER

| | |
|---|---|
| SILVER BEHENATE | 9.7 millimole/$m^2$ |
| POLY(VINYL BUTYRAL) | 4320 milligram/$m^2$ |
| SUCCINIMIDE | 8.6 millimole/$m^2$ |
| DEVELOPER H1 . . . H3 | 8.3 millimole/$m^2$ |

FORMULATION #2 DEVELOPER COMBINATIONS

| | |
|---|---|
| SILVER BEHENATE | 9.7 millimole/$m^2$ |
| POLY(VINYL BUTYRAL) | 4320 milligram/$m^2$ |
| SUCCINIMIDE | 8.6 millimole/$m^2$ |
| DEVELOPER H1–H5 | 0.5 millimole/$m^2$ |
| DEVELOPER L1–L3 | as listed in formulation 2A |

FORMULATION #2A LOW ACTIVE DEVELOPER AMOUNTS

| | |
|---|---|
| L1 | 4.6 millimole/$m^2$ |
| L2 | 9.8 millimole/$m^2$ |
| L3 | 8.0 millimole/$m^2$ |

FORMULATION #3 EXAMPLES OF THE INVENTION

These are exactly the same as formulation #2 except for the of 291.6 mg/$m^2$ of the boron compound B1. Results are shown in Table 4.

TABLE 4

Comparative Performance of Developer Mixtures

| Sample | HDEV | LDEV | Boron compound | Dynamic range | Contrast | Tonal range |
|---|---|---|---|---|---|---|
| 1 | H1 | — | — | 2.48 | 15.7 | 99 |
| 2 | H1 | L1 | — | 1.95 | 8.3 | 133 |
| 3 | H1 | L2 | — | 2.02 | 8.3 | 143 |
| 4 | H1 | L3 | — | 1.99 | 5.0 | 124 |
| 5 | H1 | L1 | B1 | 2.43 | 4.4 | 158 |
| 6 | H1 | L2 | B1 | 2.37 | 5.0 | 155 |
| 7 | H1 | L3 | B1 | 2.19 | 5.0 | 149 |
| 8 | H2 | — | — | 3.65 | 17.4 | 118 |
| 9 | H2 | L1 | — | 1.33 | 8.8 | 136 |
| 10 | H2 | L2 | — | 1.6 | 16.7 | 168 |
| 11 | H2 | L3 | — | 1.82 | 15.7 | 129 |
| 12 | H2 | L1 | B1 | 2.31 | 4.8 | 162 |
| 13 | H2 | L2 | B1 | 1.72 | 7.8 | 175 |
| 14 | H2 | L3 | B1 | 1.50 | 7.0 | 133 |
| 15 | H3 | — | — | 2.8 | 16.0 | 104 |
| 16 | H3 | L1 | B1 | 2.44 | 5.5 | 161 |
| 17 | H3 | L2 | B1 | 1.67 | 3.0 | 160 |
| 18 | H3 | L3 | B1 | 2.08 | 3.6 | 152 |
| 19 | H4 | — | — | 1.72 | 1.37 | 80 |
| 20 | H4 | L1 | B1 | 2.14 | 8.3 | 146 |
| 21 | H4 | L2 | B1 | 1.60 | 9.3 | 120 |
| 22 | H4 | L3 | B1 | 1.09 | -na- | -na- |
| 23 | H5 | — | — | 2.87 | 11.5 | 94 |
| 24 | H5 | L1 | B1 | 2.90 | 8.1 | 154 |
| 25 | H5 | L2 | B1 | 2.60 | 6.1 | 169 |
| 26 | H5 | L3 | B1 | 2.82 | 8.8 | 146 |

Average improvements of the invention versus developer alone or in combination with low activity developer are given in Table 5. As can be seen in every case the H+L+B combination produces better contrast and tonal range than the comparison.

TABLE 5

Average Improvements

| COMPARISON | CONTRAST REDUCTION | TONAL RANGE GAIN |
|---|---|---|
| H1 + L + B vs H1 | 10.9 | 55 |
| H1 + L + B vs H1 + L | 2.4 | 21 |
| H2 + L + B vs H2 | 10.8 | 38 |
| H2 + L + B vs H2 + L | 7.2 | 12 |
| H3 + L + B vs H3 | 11.9 | 54 |
| H4 + L + B vs H4 | 7.7 | 44 |
| H5 + L + B vs H5 | 3.8 | 62 |

The invention has been described in detail with particular reference to preferred embodiments, but it will be understood that variations and modifications can be effected within the spirit and scope of the invention.

What is claimed is:

1. A thermographic imaging element comprising:

(a) a support;

(b) an imaging layer comprising:

(i) a silver salt of an organic acid;

(ii) a first reducing agent which has high activity with an activation energy of less than 10 Joules/sq.cm.;

(iii) a second reducing agent which has low activity with an activation energy of greater than or equal to 10 Joules/sq. cm.; and (iv) a third reducing agent comprising a boron compound having at least one boron hydrogen bond.

2. An imaging element according to claim 1, wherein the silver salt is silver behenate.

3. An imaging element according to claim 1, wherein the first reducing agent is selected from the following reducing agents: sulfonamidophenols; substituted phenol and substituted naphthols; polyhydroxybenzenes; aminophenols; ascorbic acids; hydroxylamines; 3-pyrazolidones; hydroxycoumarones; hydroxycoumarans; hydrazones; hydroxaminic acids, indane-1,3-diones; aminonaphthols; pyrazolidine-5-ones; hydroxylamines; reductones; esters of amino reductone, hydrazines; phenylenediamines; hydroxyindane; 1,4-dihydroxypyridines; hydroxy-substituted aliphatic carboxylic acid arylhydrazides; N-hydroxyureas, phosphonamidephenols; phosphonamidanilines; α-cyanophenylacetic esters sulfonamidoanilines; aminohydroxycycloalkenone compounds; N-hydroxyurea derivatives; hydrazones of aldehydes and ketones; sulfhydroxamic acids; 2-tetrazolythiohydroquinones; tetrahydroquinoxalines; amidoximes; azines; hydroxamic acids; 2-phenylindan-1,3-dione; and 1,4-dihydropyridines.

4. An imaging element according to claim 1, wherein the first reducing agent is a compound of the formula:

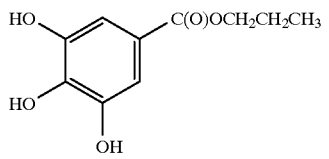

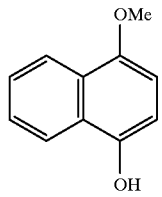

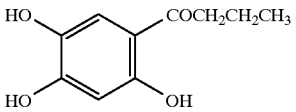

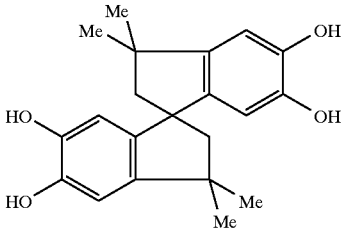

and

-continued

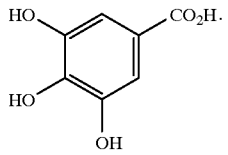

5. An imaging element according to claim 1, wherein the first reducing agent is present in an amount of about 0.005 to about 0.2 moles/mole Ag.

6. An imaging element according to claim 1, wherein the second reducing agent has an activity of greater than 10 Joules/sq.cm.

7. An imaging element according to claim 1, wherein the second reducing agent has an activity of about 10 to about 15 Joules/sq.cm.

8. An imaging element according to claim 1, wherein the second reducing agent is a compound of the formula:

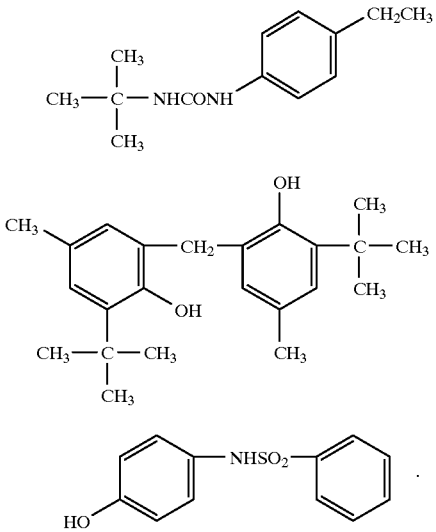

9. An imaging element according to claim 1, wherein the second reducing agent is present in an amount of about 0.05 to about 2 moles/mole Ag.

10. An imaging element according to claim 1, wherein the ratio of the first reducing agent to the amount of second reducing agent is about 1 to 3 to about 1 to 30.

11. An imaging element according to claim 1, wherein the second reducing agent is of Structure 1 or Structure 2:

STRUCTURE 1

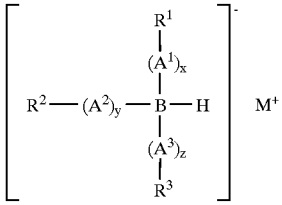

-continued

STRUCTURE 2

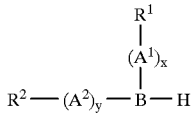

wherein $R^1$, $R^2$, $R^3$ can be the same or different, and are selected from hydrogen, substituted or unsubstituted alkyl, substituted or unsubstituted cycloalkyl, or substituted or unsubstituted aryl; or $R^1$ and $R^2$, or $R^2$, and $R^3$, or $R^1$, and $R^3$, or $R^1$ and $R^2$ and $R^3$ can form one or more ring structures; $A^1$, $A^2$ and $A^3$ each represents a non-carbon atom; x, y, and z, are independently 0 or 1 and $M^+$ is a cation.

12. An imaging element according to claim 11, wherein the boron compound is of Structure 1 and x, y and z are each 1, and $A^1$, $A^2$ or $A^3$ are independently selected from N, O, P and S.

13. An imaging element according to claim 11, wherein the boron compound is of Structure 1 and M is Li, Na, K, or $(R^4)_4N$, where $R^4$ is hydrogen, substituted or unsubstituted alkyl, substituted or unsubstituted cycloalkyl, or substituted or unsubstituted aryl.

14. An imaging element according to claim 11, wherein the boron compound is of Structure 1 and each of $R^1$, $R^2$, and $R^3$ is independently hydrogen or substituted or unsubstituted alkyl, with the proviso that if hydrogen, then the corresponding x, y or z is 0; and if substituted or unsubstituted alkyl, then the corresponding x, y or z is 1.

15. An imaging element according to claim 11, wherein the boron compound is of Structure 2, x and y are each 0 and each of $R^1$ and $R^2$ is hydrogen.

16. An imaging element according to claim 11, wherein the boron compound if of Structure 2, x and y are each 1, $A^1$ and $A^2$ are independently oxygen or nitrogen and $R^1$ and $R^2$ are each substituted or unsubstituted alkyl.

17. An imaging element according to claim 11, wherein the boron compound is of Structure 2 and is complexed with a Lewis base.

18. An imaging element according to claim 17, wherein the Lewis base is selected from $R_3N$, $R_3P$, $R_2O$, and $R_2S$, where each R is selected from: hydrogen, substituted or unsubstituted alkyl, substituted or unsubstituted cycloalkyl, and substituted or unsubstituted aryl.

19. An imaging element according to claim 1, wherein the boron compound is:

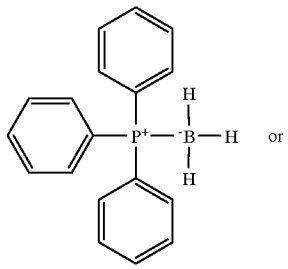

-continued
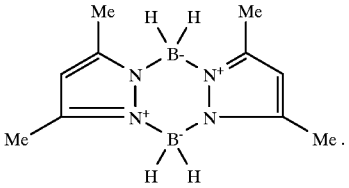
20. An imaging element according to claim 1, wherein the third reducing agent is present in an amount of about 0.005 to about 2 millimoles/mole Ag.
21. An imaging element according to claim 1, wherein the first reducing agent is:
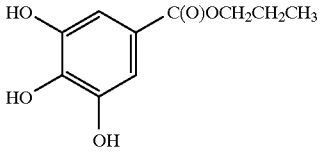
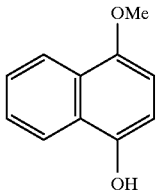
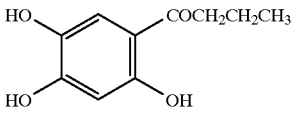
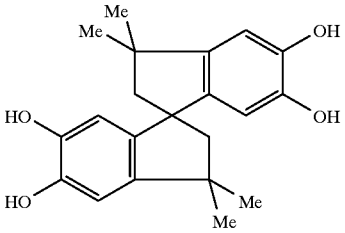
or
-continued
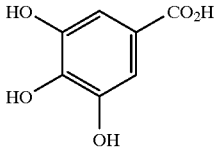
;
the second reducing agent is:
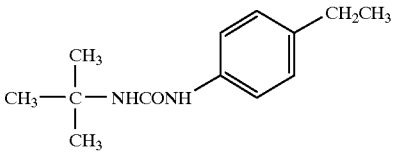
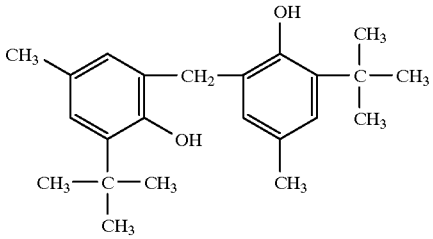
or
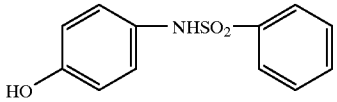
;
and the third reducing agent is:
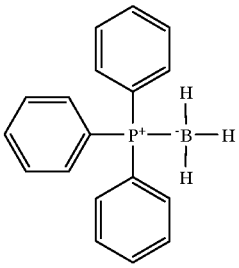
or
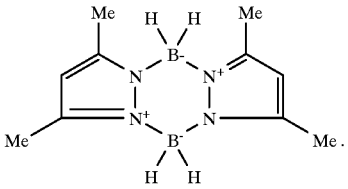
* * * * *